US007926923B2

(12) United States Patent
Umeda

(10) Patent No.: US 7,926,923 B2
(45) Date of Patent: Apr. 19, 2011

(54) INKJET PRINTER

(75) Inventor: Takaichiro Umeda, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 876 days.

(21) Appl. No.: 11/903,616

(22) Filed: Sep. 24, 2007

(65) Prior Publication Data

US 2008/0079786 A1 Apr. 3, 2008

(30) Foreign Application Priority Data

Sep. 29, 2006 (JP) ..... 2006-267762

(51) Int. Cl.
*B41J 2/175* (2006.01)

(52) U.S. Cl. ..... 347/85

(58) Field of Classification Search ..... 347/7, 84, 347/85

See application file for complete search history.

(56) References Cited

U.S. PATENT DOCUMENTS 4,383,263 A * 5/1983 Ozawa et al. ..... 347/30
5,774,154 A * 6/1998 Underwood ..... 347/85
5,777,649 A 7/1998 Otsuka et al.
5,886,718 A * 3/1999 Johnson et al. ..... 347/85
5,889,543 A * 3/1999 Miyazawa et al. ..... 347/86
5,979,304 A 11/1999 Norais
6,996,641 B2 11/2005 Taniguchi et al.
7,488,058 B2 * 2/2009 Okamoto et al. ..... 347/84

FOREIGN PATENT DOCUMENTS

JP 2004181952 7/2004
JP 2005193123 7/2005

* cited by examiner

*Primary Examiner* — Anh T. N. Vo
(74) *Attorney, Agent, or Firm* — Frommer Lawrence & Haug LLP

(57) ABSTRACT

An inkjet printer that includes a main tank with ink, a sub-tank unit including a sub-tank, an ink supply mechanism including an ink absorber. Wherein the ink supply mechanism supplies ink from the main tank to the sub-tank. Wherein the main tank and the sub-tank are disconnected from each other when ink is not being supplied from the main tank to the sub-tank, and are connected to each other via the ink supply mechanism when ink is being supplied from the main tank to the sub-tank. Wherein the ink absorber is positioned in the ink supply mechanism so as to absorb ink from the sub-tank. Wherein the ink absorber is also positioned in the ink supply mechanism so as to present less resistance to ink flowing through the ink supply mechanism into the sub-tank than when ink is not being supplied from the main tank to the sub-tank.

10 Claims, 9 Drawing Sheets

150
151A
TO SUB-TANK
151B
156
160
162
163
164
UP
DOWN
TO INK CARTRIDGE
151
155
154
152
165
167
161
168

110
100
121
120
122A
122D
122
122B
150
160
180
182
SHEET CONVEYING DIRECTION
UP
DOWN
181
183
166
130
131
132
170
140

TO SUB-TANK
UP
DOWN
FROM INK CARTRIDGE
150
151A
154
156
160
162
163
164
151
155
152
165
167
161
168

TO SUB-TANK
UP
DOWN
FROM INK CARTRIDGE
150
151A
154
156
160
162
163
164
151
155
152
165
167
161
168

TO SUB-TANK
TO SUB-TANK JOINT VALVE
UP
DOWN
190
191
191A
191B
192
192A
193
194
195
158

TO SUB-TANK
TO SUB-TANK JOINT VALVE
UP
DOWN
190
191
191A
191B
192
192A
193
194
195
158

INKJET PRINTER

This application claims priority from Japanese Patent Application No. 2006-267762 filed on Sep. 29, 2006, the entire subject matter of which is incorporated herein by reference.

BACKGROUND OF THE INVENTION

1. Field of the Invention

The invention relates to an inkjet printer adopting a station type ink supply system in which a main tank and a sub-tank are capable of being connected to, and disconnected from, each other. The main tank and the sub-tank are connected to each other when ink is supplied from the main tank to the sub-tank.

2. Description of Related Art

In a printhead of an inkjet printer, a droplet of liquid, such as ink, is ejected from a nozzle by a piezoelectric element when the piezoelectric element deforms. The droplet of liquid may also be ejected from the nozzle by a heat-generating resister when that heat generating element volumetrically changes an air bubble. Usually, the nozzle is not provided with a valve. Rather, a meniscus is formed in the nozzle in a concave manner inwardly from the nozzle surface so that no ink leaks from the nozzle when the printhead is in a stand-by mode.

The nozzle is a small opening. Accordingly, liquid in the nozzle forms a dome-shaped meniscus therein due to surface tension. The meniscus is concave when the pressure inside the nozzle is less than the atmospheric pressure. Such a meniscus prevents the liquid from leaking from the nozzle when the printhead is in stand-by mode.

Japanese Laid-Open Patent Application No. 2004-181952 discloses an inkjet printer adopting a station type ink supply system in which an ink absorber made of a porous member is disposed in a sub-tank which is mounted on a printhead. The ink absorber absorbs ink due to capillary action, thereby decreasing the pressure in the sub-tank. In this way, the pressure in the sub-tank is made to be less than the atmospheric pressure, thereby ensuring that a meniscus is formed in each nozzle of the printhead.

The porous member may be a formed or sponge member having a number of open cells (spaces). The porous member may also be a member made of interlaced fibers that create a number of open cells (spaces).

Ink is supplied from the main tank to the sub-tank via an ink supply path. When an ink absorber is disposed in this ink path, the ink absorber may create a great resistance to the flow of ink through the ink path. Accordingly, ink cannot be quickly supplied from the main tank to the sub-tank.

In view of the forgoing problem, it is an object of the invention to provide an inkjet printer adopting a station type ink supply system in which ink is quickly supplied from a main tank to a sub-tank while maintaining a meniscus in each nozzle of a printhead when the printhead is in stand-by mode.

SUMMARY OF THE INVENTION

An inkjet printer that includes a main tank that holds ink, a sub-tank unit including a sub-tank, an ink supply mechanism including an ink absorber, and a printhead unit including a printhead for ejecting ink onto a sheet. Wherein the ink supply mechanism connects the main tank to the sub-tank, so as to supply ink from the main tank to the sub-tank. Wherein the sub-tank unit is mounted on the printhead unit and supplies ink to the printhead. Wherein the main tank and the sub-tank are configured so as to be disconnected from each other via the ink supply mechanism when ink is not being supplied from the main tank to the sub-tank. Wherein the main tank and the sub-tank are configured so as to be connected to each other via the ink supply mechanism when ink is being supplied from the main tank to the sub-tank. Wherein, when ink is not being supplied from the main tank to the sub-tank, the ink absorber is positioned in the ink supply mechanism such that the ink absorber absorbs ink from the sub-tank. Wherein, when ink is being supplied from the main tank to the sub-tank, the ink absorber is positioned in the ink supply mechanism such that the ink absorber presents less resistance to ink flowing through the ink supply mechanism into the sub-tank than when ink is not being supplied from the main tank to the sub-tank.

DETAILED DESCRIPTION OF EMBODIMENTS

Figure 1:
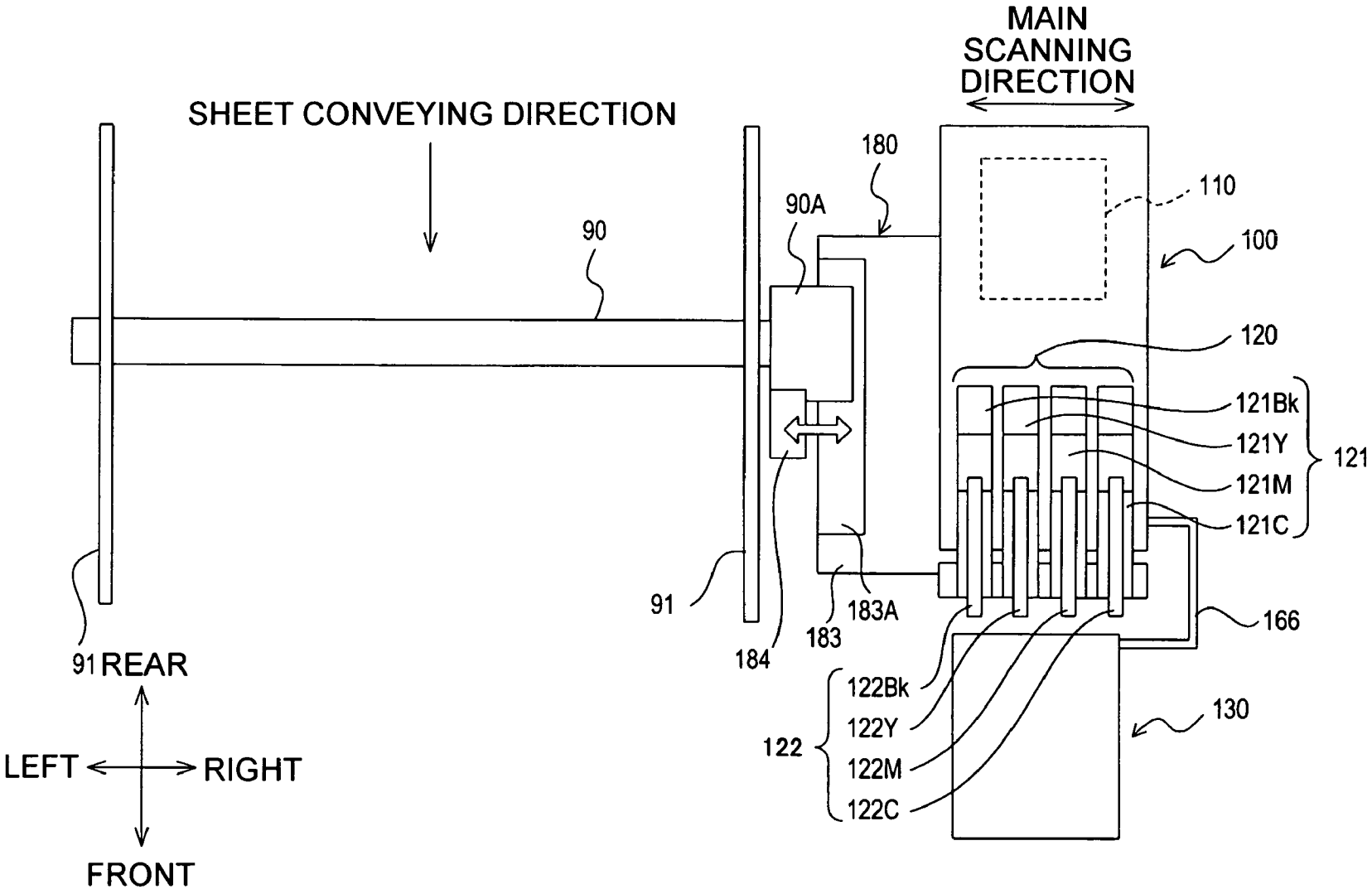
FIG. 1 is a schematic diagram of an image forming section of an inkjet printer as viewed from the above, according to a first embodiment of the invention.

Referring now to the drawings, the present invention will be described in detail on the basis of the preferred embodiments.

An inkjet printer forms an image on a sheet of recording media by ejecting ink droplets onto the sheet. The inkjet printer forms a multi-color image by overlapping inks of basic colors including cyan, magenta, yellow, and black.

In a station type ink supply system, a main tank unit 130 and a sub-tank 121 are connected to each other to enable ink to be supplied from the main tank unit 130 to the sub-tank 121. The main tank unit 130 and the sub-tank 121 are disconnected from each other when the main tank unit 130 is not supplying the sub-tank unit 121 with ink. In this way, the station type ink supply system enables an ink supply path between a sub-tank 121 and a main tank 130 to be connectable/disconnectable.

In a first embodiment, when the amount of ink remaining in the sub-tank 121 becomes less than a predetermined amount, ink is supplied from the main tank unit 130 to the sub-tank 121 while they are connected to each other. When the amount of ink remaining in the sub-tank 121 is greater than the predetermined amount, the main tank unit 130 and the sub-tank 121 are kept disconnected from each other.

A printhead unit (carriage) 100 includes a printhead 110 that ejects ink droplets onto the sheet, and a sub-tank unit 120 that supplies ink to the printhead 110. When forming an image, the printhead unit 100 reciprocates in a main scanning direction (right-left direction in FIG. 1) that is perpendicular to a sheet conveying direction.

Nozzles for ejecting basic color inks are formed in a surface of the printhead 110 that faces the sheet to be conveyed. The nozzles are arranged in arrays parallel to the sheet conveying direction. Each nozzle array corresponds to a particular one of the basic color inks.

The sub-tank unit 120 includes sub-tanks 121C, 121M, 121Y, 121Bk, arranged side by side in the main scanning direction, and levers 122C, 122M, 122Y, 122Bk, each pushing a corresponding one of the sub-tanks 121C, 121M, 121Y, 121Bk.

The sub-tank 121C is filled with a cyan ink, the sub-tank 121M is filled with a magenta ink, the sub-tank 121Y is filled with a yellow ink, and the sub-tank 121Bk is filled with a black ink.

The sub-tanks 121C, 121M, 121Y, and 121Bk are collectively called sub-tank(s) 121, because they are the same except for the color of the ink to be stored therein. Also, the levers 122C, 122M, 122Y, 122Bk are collectively called lever (s) 122 because they are the same except that they push different sub-tanks 121.

The sub-tank 121 is configured to deform (expand and contract) elastically in a direction perpendicular to both the main scanning direction and the sheet conveying direction. To be specific, the sub-tank 121 has a form of bellows, as shown in FIG. 2A.

Figure 2B:
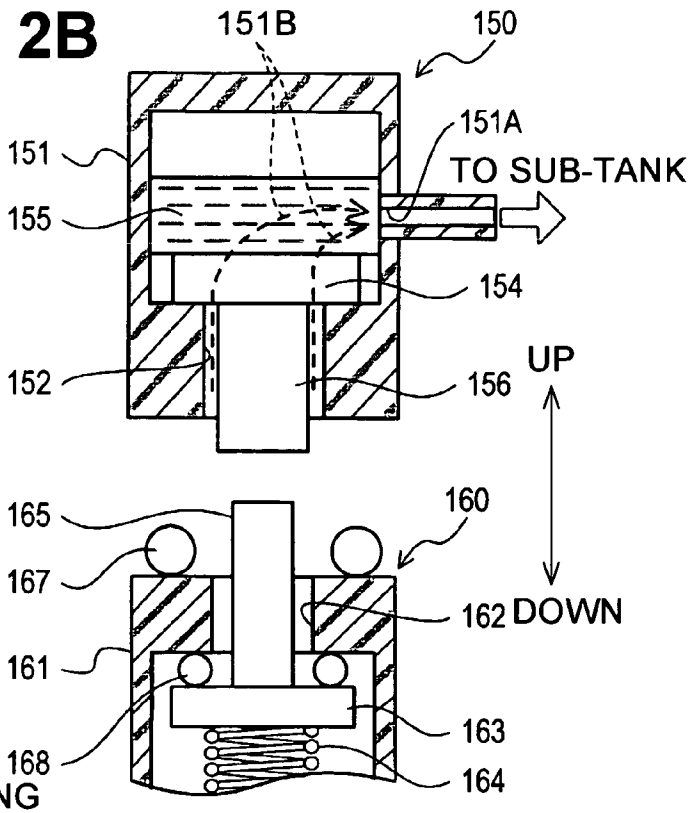
FIG. 2B is an illustrative diagram showing joint valves operated during an ink supply operation according to the first embodiment of the invention.
Figure 2A:
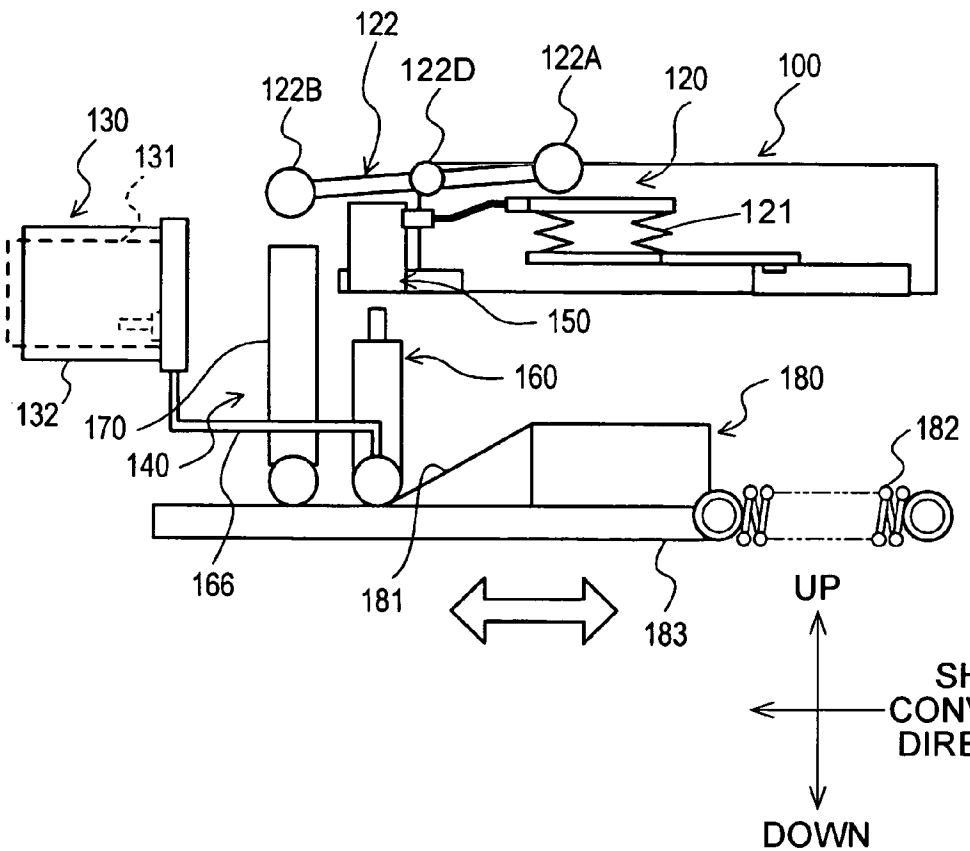
FIG. 2A is a schematic diagram of an ink supply mechanism according to the first embodiment of the invention.

As shown in FIG. 2A, the lever 122, as a pushing member, is connected, at its one end 122A, to an upper end of each sub-tank 121 and extends, at its other end 122B beyond an outer edge of the printhead unit 100. The lever 122 is rotatably supported by a support 122D that is fixed to a main body of the printhead unit 100.

As shown in FIG. 2A, the main tank unit 130 includes ink cartridges 131 filled with ink to be supplied to the corresponding sub-tanks 121, and a cartridge casing 132 detachably receiving the ink cartridges 131.

The ink cartridges 131 are mounted in the cartridge casing 132 and are arranged side by side horizontally such that the width direction of the ink cartridges 131 coincides with the horizontal direction. Each of the ink cartridges 131 has a box shape having a relatively small width as compared to its other dimensions.

Construction of a station type ink supply mechanism will now be described. As shown in FIG. 2A, a station type ink supply mechanism (hereinafter referred to as an ink supply mechanism) 140 includes a sub-tank joint valve 150, a main tank joint valve 160, a push rod 170 that pushes the end 122B of the lever 122, and a slide cam 180 that actuates the main tank joint valve 160 and the push rod 170.

Each of the sub-tanks 121 is provided with the sub-tank joint valve 150, main tank joint valve 160, and the push rod 170, and the structures of these members are the same among the sub-tanks 121. The slide cam 180 is provided commonly for the sub-tanks 121, and the slide cam 180 is integral with a base plate 183. Accordingly, all of the sub-tanks 121 are replenished with ink simultaneously. This is the case even if one or more of the sub-tanks 121 do not need to be replenished with ink. The process for replenishing the ink tanks will be described in detail below.

The sub-tank joint valve 150, as a connecting valve, is fixed to the main body of the printhead unit 100 and communicates with the sub-tank 121. The sub-tank joint valve communicates with the sub-tank 121 on an upper side of the sub-tank 121, and the sub-tank 121 communicates with the printhead 110 at a lower side of the sub-tank 121.

As shown in FIG. 2B, a valve opening 152 is provided in the cylindrical valve housing 151 at an end near the main tank joint valve 160. The valve opening 152 is closed by a valve member 154 that is shiftable inward of the valve housing 151.

An ink absorber 155 for absorbing ink in the sub-tank 121 toward the valve opening 152 is shiftably disposed in an ink path 151B that extends from the valve opening 152 to a port 151A communicating with the sub-tank 121. The valve opening 152 is located near the connecting portions between the sub-tank valve joint 150 and the main tank valve joint 160.

In this first embodiment, the ink absorber 155 is integral with the valve member 154 using an adhesive or the like, and thus the ink absorber 155 is shifted at the same time the valve member 154 is shifted.

Figures 3A, 3B:
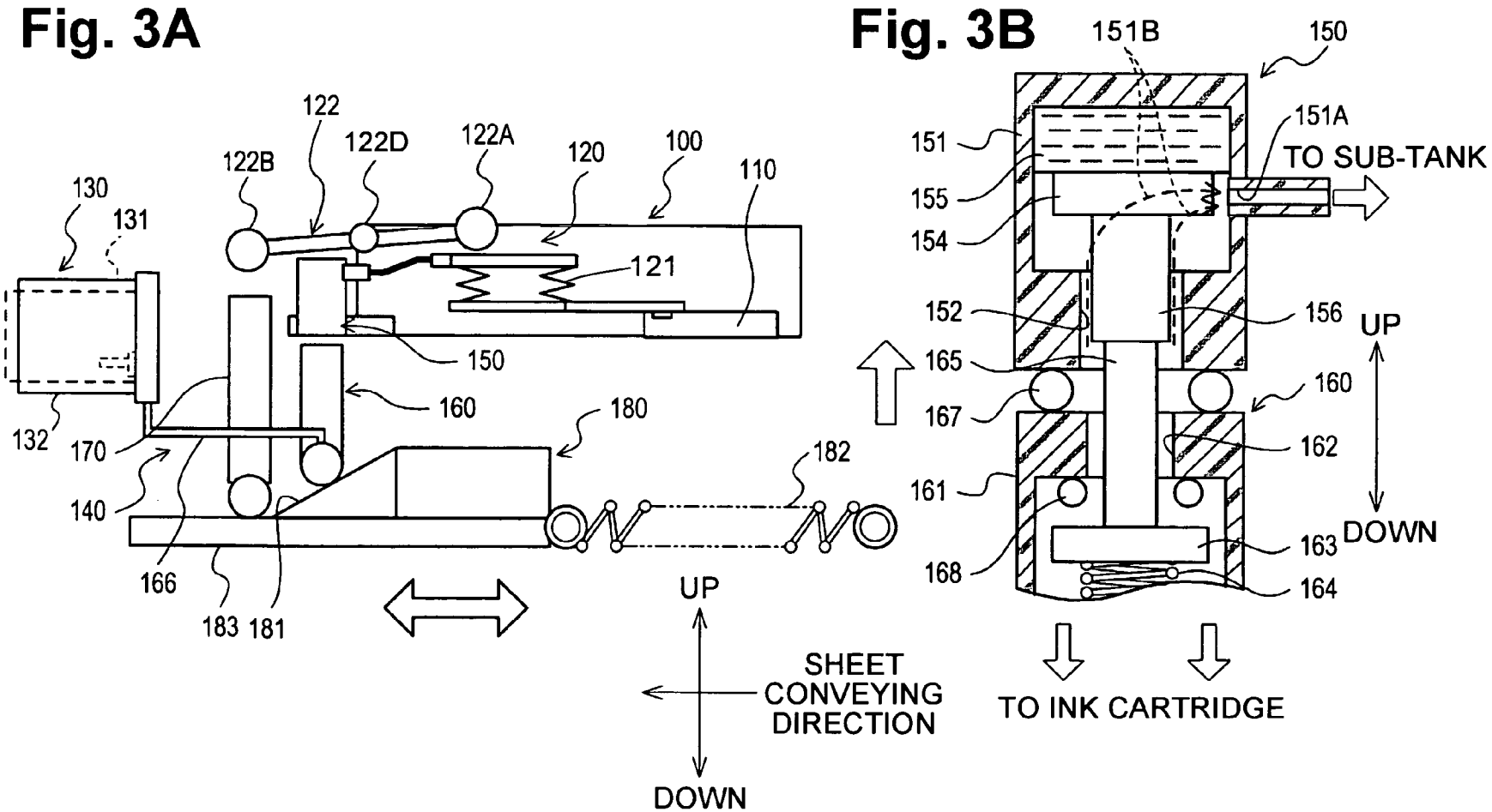
FIG. 3A is a schematic diagram of an ink supply mechanism according to the first embodiment of the invention.
FIG. 3B is an illustrative diagram showing joint valves operated during an ink supply operation according to the first embodiment of the invention.

To be specific, when the valve opening 152 is closed, as shown in FIG. 2B, the ink absorber 155 is located in the ink path 151B at a position to block the port 151A. When the valve opening 152 is opened, as shown in FIG. 3B, the ink absorber 155 is located at a position retracted away from the ink path 151B.

The ink absorber 155 may be a formed or sponge member having a number of open cells (spaces). The ink absorber 155 may also be a member made of interlaced fibers that create a number of open cells (spaces). The ink absorber 155 absorbs ink with the open cells due to capillary action.

The valve member 154 has a push rod 156 that penetrates the valve opening 152 and extends toward the main tank joint valve 160. The push rod 156 and the valve member 154 are shifted integrally.

To supply ink from the ink cartridge 131 to the sub-tank 121, the main tank joint valve 160 is connected to the sub-tank joint valve 150, such that the sub-tank 121 communicates with the ink cartridge 131. The main tank joint valve 160 communicates with the ink cartridge 131 via an ink supply conduit such as a pipe or a tube.

As shown in FIG. 2B, a valve opening 162 is provided at a position to face the sub-tank joint valve 150. The valve opening 162 is closed by a valve member 163 that is shiftable inward of the valve housing 161.

A coil spring 164, as an elastic member, exerts a pushing force on the valve member 163 to close the valve opening 162. A push rod 165 projects toward the sub-tank joint valve 150 to push the valve member 154 of the sub-tank joint valve 150, so as to open the valve opening 152. The push rod 165 is integral with the valve member 163 and is shifted integrally with the valve member 163.

As shown in FIG. 3B, an O ring 167 is a sealing member that prevents ink leakage from the connecting portions between the joint valves 150 and 160 to the outside. In addition, an O ring 168 is disposed between the valve member 163 and an outer periphery of the valve opening 162 to hermetically seal the valve opening 162.

The O rings 167, 168 are made of an elastically deformable material such as nitrile rubber. The slide cam 180 has a cam surface 181 that contacts longitudinal ends of both the push rod 170 and the main tank joint valve 160, thereby shifting the push rod 170 and the main tank joint valve 160 in their longitudinal directions (vertical directions in FIG. 3A).

In this first embodiment, in order to move the push rod 170 and the main tank joint valve 160 upward, the slide cam 180 is moved leftward in FIG. 2A by a driving force from a discharge roller 90 (see FIG. 1).

In order to move the push rod 170 and the main tank joint valve 160 downward, the driving force from the discharge roller 90 is disconnected and the slide cam 180 is moved rightward in FIG. 2A by an elastic force of a spring 182.

The slide cam 180 that is provided commonly for the sub-tanks 121 is integral with a base plate 183. As shown in FIG. 1, the base plate 183 is provided, on its side near the discharge roller 90, with a rack gear 183A.

A pinion gear 184 that transmits the driving force from a gear 90A, disposed at an longitudinal end of the discharge roller 90, to a rack gear 183A, disposed on the base plate 183, is disposed movably between a position where the pinion gear 184 meshes with the rack gear 183A and a position where the pinion gear 184 is released from the rack gear 183A. The positions of the pinion gear 184 are changed by an actuator. One example of such an actuator is an electromagnetic solenoid.

The discharge roller 90 conveys a sheet, with an image printed thereon, to a discharge port (not shown). The sheet is conveyed between a pair of frames 91 to the discharge port.

Operation of the ink supply mechanism will now be described. The ink supply mechanism 140, as a station type ink supply mechanism, connects the main tank joint valve 160 to the sub-tank joint valve 150, so as to supply ink from the ink cartridge 131 to the sub-tank 121 when the amount of ink remaining in the sub-tank 121 becomes less than a predetermined amount.

In this first embodiment, the time at which the amount of oil remaining in the sub-tank 121 becomes less than the predetermined amount is determined based on the number of ink ejections that are performed by the printhead 10 for both printing and purging. The ink ejections are counted starting from the last time that ink was supplied to the sub-tank 121. When the number of ink ejections reaches a predetermined number, the amount of remaining ink is estimated to be less than the predetermined amount.

When a controller (not shown) that controls operation of the inkjet printer determines that the amount of ink remaining in the sub-tank 121 is less than the predetermined amount, the controller moves the pinion gear 184 to the position to mesh with the rack gear 183A and rotates the discharge roller 90.

Consequently, the slide cam 180 is moved leftward in FIG. 3A, thereby moving the push rod 170 and the main tank joint valve 160 upward.

As shown in FIG. 3B, the main tank joint valve 160 raises up the valve member 154 of the sub-tank joint valve 150, thereby opening the valve opening 152.

At the same time, the valve member 163 of the main tank joint valve 160 receives a pushing force to open the valve opening 162 via the push rod 165. The valve member 163 is shifted downward to open the valve opening 162, thereby bringing the sub-tank 121 in communication with the ink cartridge 131.

Figures 4A, 4B:
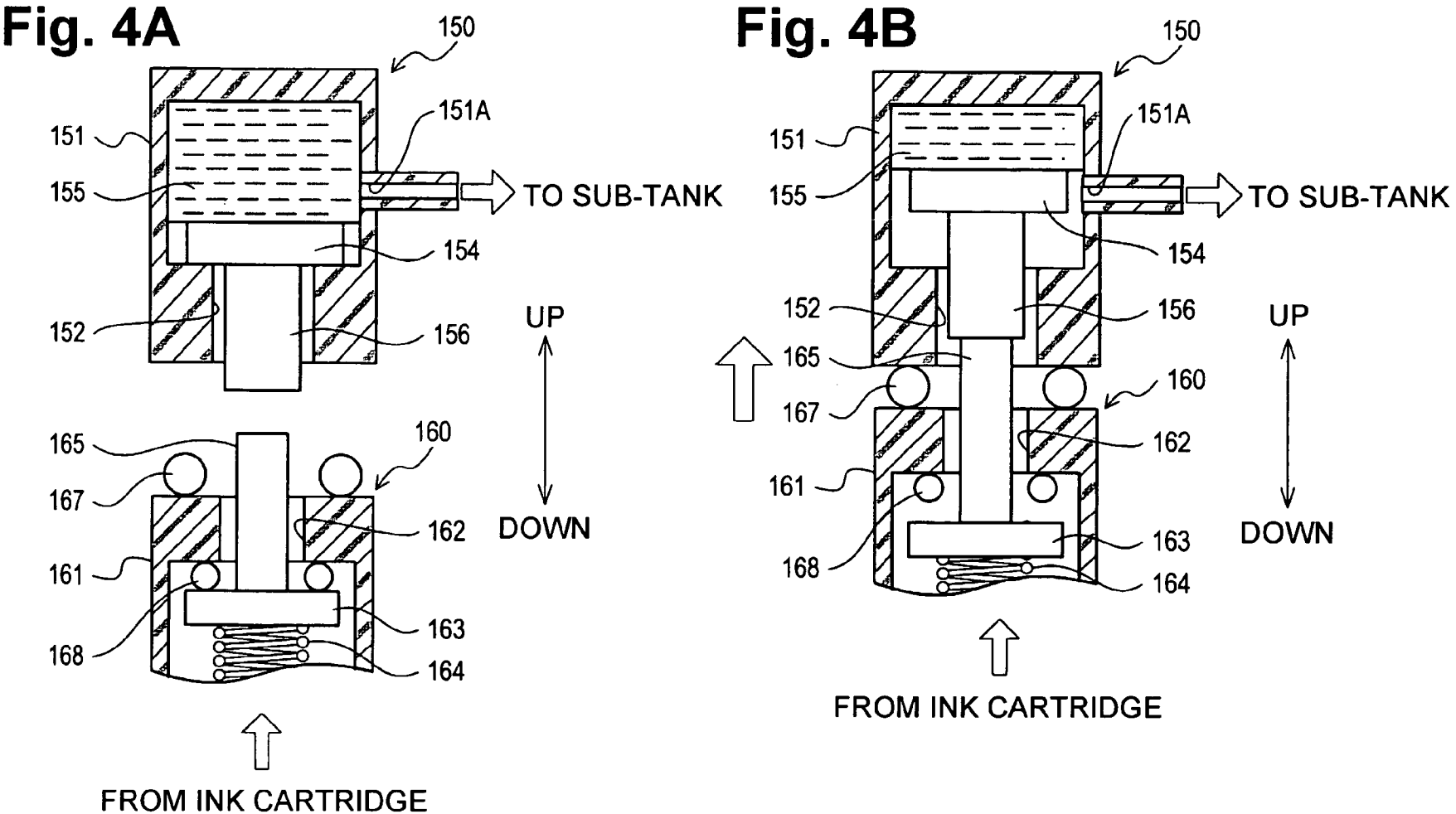
FIGS. 4A and 4B are schematic diagrams of an ink supply mechanism according to a second embodiment of the invention.

The upper end of the push rod 170 pushes up the other end 122B of the lever 122. As shown in FIG. 4A, the end 122A of the lever 122 moves downward to compress and deform the sub-tank 121. At this time, ink remaining in the sub-tank 121 returns to the ink cartridge 131 and is not wasted.

In this embodiment, the shape of the cam surface 181 and the moving direction of the slide cam 180 are set such that compression of the sub-tank 121 is started after the sub-tank joint valve 150 has been connected to the main tank joint valve 160. If the sub-tank 121 is compressed before the connection between the joint valves 150 and 160, ink might leak from the connecting portions of the joint valves 150 and 160.

Also, the shape of the cam surface 181, and the moving speed of the slide cam 180, are set such that the sub-tank 121 is compressed with a pressure that will not break a meniscus formed in each ejection port of the printhead 110 (e.g. 4 kPa or smaller). If the sub-tank 121 is compressed with an excessively great pressure, the meniscus might be broken.

When a predetermined time has elapsed after the discharge roller 90 is rotated while the pinion gear 184 meshes with the rack gear 183A, or when the total rotation amount of the discharge roller 90 reaches a predetermined amount, the controller determines that the compression of the sub-tank is completed. The controller then moves the pinion gear 184 to the position to be released from the rack gear 183A and stops the discharge roller 90.

Consequently, the slide cam 180 starts moving rightward, the push rod 170 is shifted downward, and the sub-tank 121 expands to return to its original shape. At this time, ink in the ink cartridge 131 is drawn and supplied to the sub-tank 121.

When the slide cam 180 moves further rightward in FIG. 2A, the push rod 170 is shifted away from the lever 122, and the joint valves 150 and 160 disconnect from each other and close. At this time, as shown in FIG. 2B, the ink absorber 155 is located at a position to block the port 151A.

In this first embodiment, the shape of the cam surface 181 and the moving direction of the slide cam 180 are set such that the connection between the joint valves 150 and 160 is released after the push rod 170 has been separated from the lever 122. If the connection between the joint valves 150 and 160 is released while the push rod 170 is in contact with the lever 122, ink might leak from the connecting portions of the joint valves 150 and 160.

As shown in FIG. 2B, the ink absorber 155 is located in the ink path 151B at a position to block the port 151A during the image forming process. The ink absorber 155 absorbs, by its absorbing force, ink from the sub-tank 121 via the port 151A). As a result, the pressure in the sub-tank 121 is kept at less than the atmospheric pressure, thereby maintaining the meniscuses formed in the nozzles of the printhead 110.

In the first embodiment, when the main tank unit 130 is connected to the sub-tank 121, the ink absorber 155 is retracted away from the ink path 151B. Accordingly, when ink is supplied through the ink path 151B, the ink absorber 155 is prevented from presenting much resistance to the flow of ink in the ink path 151B.

On the other hand, when the main tank unit 130 is disconnected from the sub-tank 121, the ink absorber 155 is located in the ink path 151B at a position to block the port 151A. Accordingly, the meniscuses formed in the nozzles of the printhead 110 are maintained.

Therefore, in the ink jet printer according to the first embodiment, meniscuses formed in the nozzles of the printhead 110 can be maintained by the ink absorber 155 when the main tank unit 130 is disconnected from the sub-tank 121, and ink can be quickly supplied to the sub-tank 121 when the main tank unit 130 is connected to the sub-tank 121.

Furthermore, because the ink absorber 155 is shifted mechanically by the opening and closing of the valve member 154, there is no need to provide an actuator exclusively for retracting the ink absorber 155 from the ink path 151B. This results in a reduced number of parts and a reduced manufacturing cost.

A second embodiment of the invention will now be described. The same reference numbers are used for the same or like parts as in the first embodiment. In the first embodiment, the ink absorber 155 is shifted to be retracted away from the ink path 151B. In the second embodiment, an ink absorber 155, which is made of an elastically deformable material, such as a sponge or a foam, is compressed such that at least a part of the ink absorber 155 is retracted away from an ink path 151B.

FIG. 4A shows a state where the ink absorber 155 is blocking the port 151A, and FIG. 4B shows a state where the ink absorber 155 is retracted away from the ink path 151B.

As shown in FIG. 4A, when no ink is being supplied to a sub-tank 121, including during the image forming process, the ink absorber 155 is located at a position to block the port 151A. The pressure in the sub-tank 121 is kept at less than the atmospheric pressure, thereby maintaining meniscuses formed in the nozzles of the printhead 110.

As shown in FIG. 4B, to supply ink to the sub-tank 121, a main tank joint valve 160 is moved upward such that a push rod 165 of the joint valve 160 pushes up a valve member 154 of a sub-tank joint valve 150. At the same as the valve member 154 is pushed up, the ink absorber 155 is compressed and is retracted away from the ink path 151B.

As a result, the ink absorber 155 in the second embodiment is also prevented from presenting much resistance to the flow of ink from a main tank unit 130 to the sub-tank 121.

On the other hand, when main tank unit 130 and the sub-tank 121 are disconnected from each other, the meniscuses formed in the nozzles of the printhead 110 are maintained by the ink absorber 155.

Therefore, in the ink jet printer according to the second embodiment, meniscuses formed in the nozzles of the printhead 110 can be maintained by the ink absorber 155 when the main tank unit 130 is disconnected from the sub-tank 121, and ink can be quickly supplied to the sub-tank 121 when the main tank unit 130 is connected from the sub-tank 121.

When the ink absorber 155 is retracted, the ink absorber 155 is compressed to discharge the ink absorbed therein. This prevents the ink absorbed by the ink absorber 155 from remaining therein and getting old.

As shown in FIGS. 4A and 4B, the ink absorber 155 is retracted from the ink path 151B by being compressed from one end while the position at the other end is unchanged. Alternatively, the ink absorber 155 may be compressed from one end while the position at the other end is shifted.

A third embodiment of the invention will now be described. The same reference numbers are used for the same or like parts as in the first embodiment. In the first embodiment, the valve member 154 retracts the ink absorber 155 away from the ink path 151B. In the third embodiment, a lever 122 is used to retract an ink absorber 155 from an ink path 151B.

Figure 5A:
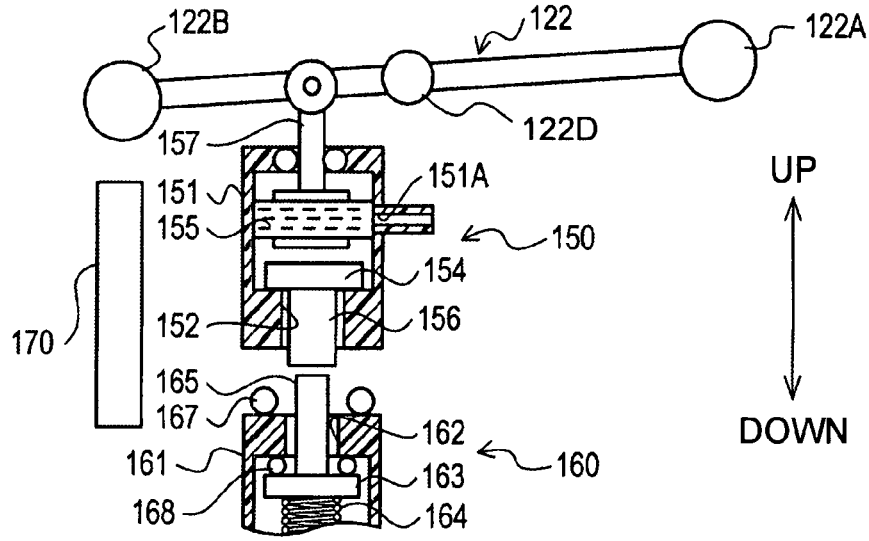
FIGS. 5A, 5B, and 5C are schematic diagrams of an ink supply mechanism according to a third embodiment of the invention.
Figure 5B:
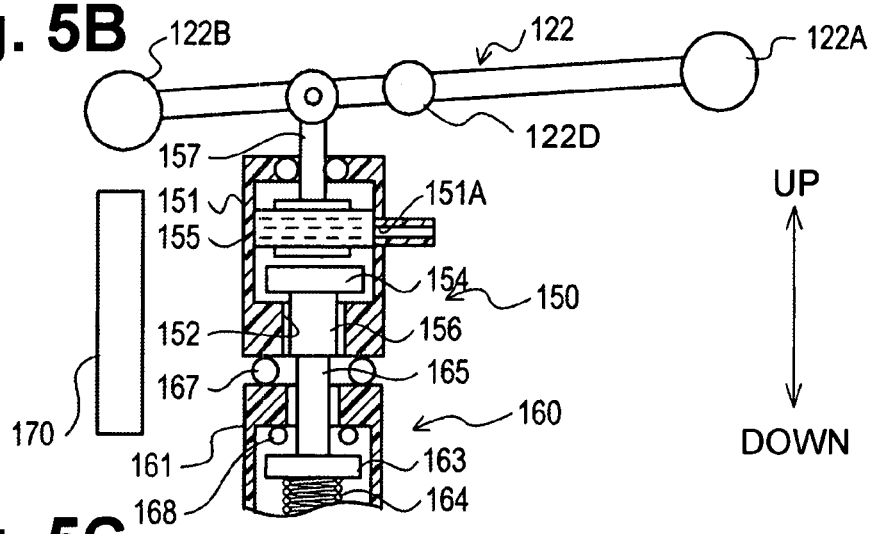
Figure 5C:
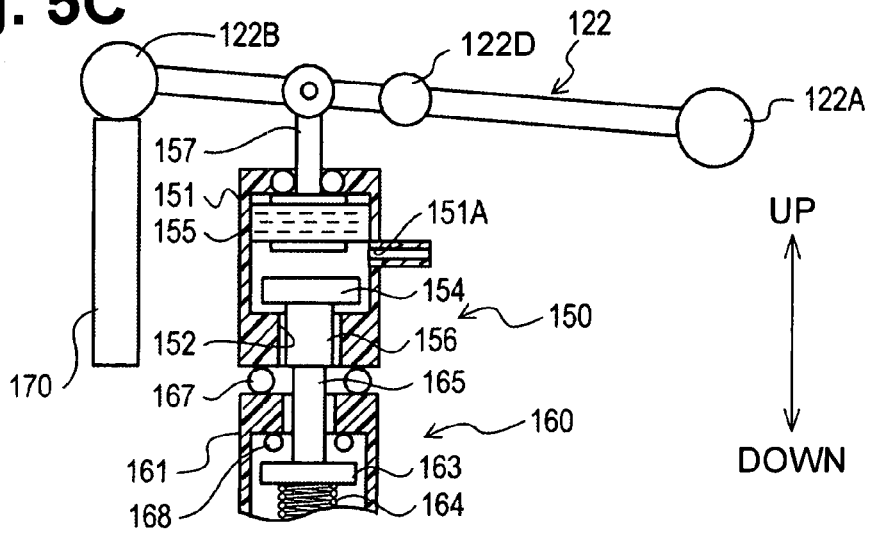

FIGS. 5A-5C show an operation of an ink supply mechanism 140. A pull rod 157 penetrates a valve housing 151 of a sub-tank joint valve 150. The pull rod 157 is rotatably connected at its one end to the lever 122, and is connected at its other end to the ink absorber.

As shown in FIG. 5A, when no ink is supplied to the sub-tank 121, including during the image forming process, a push rod 170 and an end 122B of the lever 122 are not in contact with each other. In this state, the ink absorber 155 is located in the ink path 151B at a position to block a port 151A from communicating with the sub-tank 121. Accordingly, the ink absorber 155 absorbs ink from the sub-tank 121, thereby maintaining meniscuses formed in the nozzles of the printhead 110.

As shown in FIG. 5B, to supply ink to the sub-tank 121, a main tank joint valve 160 is moved into contact with a sub-tank joint valve 150 such that the two are connected to each other.

Subsequently, as shown in FIG. 5C, a push rod 170 pushes up the end 122B of the lever 122. This moves the pull rod 157 upward, thereby shifting the ink absorber 155 away from the ink path 151B.

As a result, the ink absorber 155 in the third embodiment is also prevented from presenting much resistance to the flow of ink from a main tank unit 130 to the sub-tank 121.

On the other hand, when the main tank unit 130 and the sub-tank 121 are disconnected from each other, meniscuses formed in the nozzles of the printhead 110 are maintained by the ink absorber 155.

Therefore, in the inkjet printer according to the third embodiment, meniscuses formed in the nozzles of the printhead 110 can be maintained by the ink absorber 155 when the main tank unit 130 is disconnected from the sub-tank unit 121, and ink can be quickly supplied to the sub-tank 121 when the main tank unit 130 is connected to the sub-tank 121.

As shown in FIGS. 5A, 5B, and 5C, the ink absorber 155 is shifted to be retracted away from the ink path 151B. Alternatively, the ink absorber 155 may be compressed so as to be retracted away from the ink path 151B, or the ink absorber 155 may be shifted while being partially compressed so as to be retracted away from the ink path 151B.

A forth embodiment of the invention will now be described. The same reference numbers are used for the same or like parts as in the first embodiment. In the first, second, and third embodiments, the ink absorber 155 is shifted and/or compressed in the valve housing 151 of the sub-tank joint valve 150, so as to be retracted away from the ink path 151B. In the forth embodiment, as shown in FIG. 6, a retracting mechanism 190 for retracting an ink absorber 158 is disposed in an ink path between a sub-tank joint valve 150 and a sub-tank 121.

Figure 6:
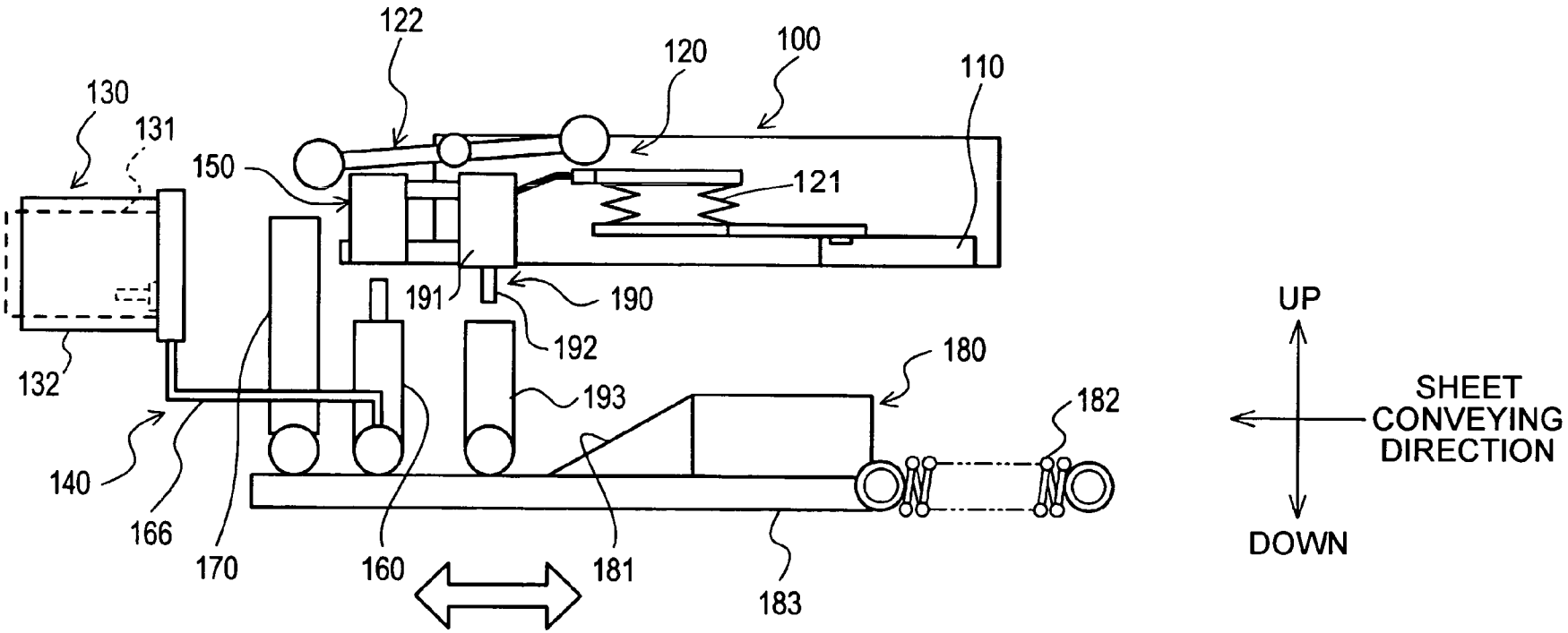
FIG. 6 is a schematic diagram of an ink supply mechanism according to a forth embodiment of the invention.
Figures 7A, 7B:
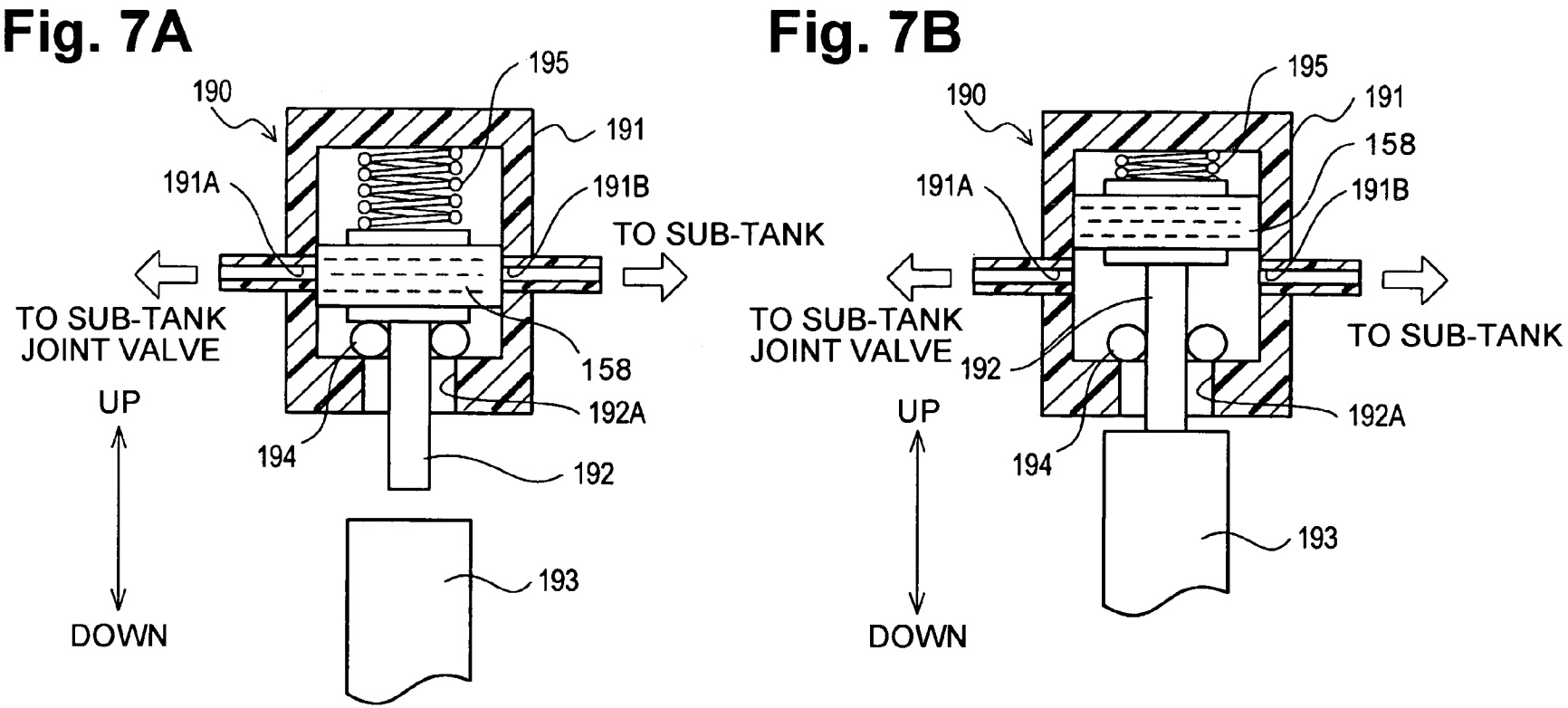
FIGS. 7A and 7B are illustrative diagrams showing an ink supply operation according to the forth embodiment of the invention.

FIG. 6 is a schematic diagram showing the locations of an ink supply mechanism 140 which includes the retracting mechanism 190. FIGS. 7A and 7B show the structure of the retracting mechanism 190. As shown in FIGS. 7A and 7B, the retracting mechanism 190 includes a housing 191 in which an ink absorber 158 is shiftably disposed, a shaft 192 that moves the ink absorber 158, and a push rod 193 that pushes the shaft 192 when the push rod 193 is pushed by a slide cam 180 (see FIG. 6). The housing 191 has a first port 191A which communicates with the sub-tank joint valve 150, and a second port 191B which communicates with the sub-tank 121.

An O ring 194 is provided as a sealing member to prevent ink leakage from an opening 192A through which the shaft 192 penetrates. A coil spring 195 is provided as an elastic member to push the shaft 192 and the ink absorber 158 toward the push rod 193.

As shown in FIG. 7A, when no ink is being supplied to the sub-tank 121, including during the image forming process, the shaft 192 and the ink absorber 158 are pushed toward the push rod 193 by the coil spring 195. Thus, the ink absorber 158 is located in the ink path so as to block the second port 191B.

As shown in FIG. 7B, to supply ink to the sub-tank 121, the shaft 192 is pushed upward toward the housing 191 by the push rod 193, which is in turn shifted by the slide cam 180. Thus, the ink absorber 158 is retracted away from the ink path so as to open the second port 191B.

Therefore, in the ink jet printer according to the forth embodiment, meniscuses formed in the nozzles of the printhead 110 can be maintained by the ink absorber 158 when the main tank unit 130 is disconnected from the sub-tank 121, and ink can be quickly supplied to the sub-tank 121 when the main tank unit 130 is connected from the sub-tank 121.

As shown in FIGS. 7A and 7B, the ink absorber 158 is shifted to be retracted away from the ink path. Alternatively, the ink absorber 158 may be compressed so as to be retracted from the ink path, or the ink absorber 158 may be shifted while being partially compressed so as to be retracted from the ink path.

A fifth embodiment of the invention will now be described. The same reference numbers are used for the same or like parts as in the first embodiment. In the first through fourth embodiments, the ink path extending from the connecting portions between the sub-tank joint valve 150 and the main tank joint valve 160 to the sub-tank 121 is a single ink path. In the fifth embodiment, a plurality of ink paths (e.g., two ink paths) are provided instead of a single ink path, and an ink absorber 159 is disposed in at least one of the ink paths. The ink path with the ink absorber 159 and the ink path with no ink absorber selectively communicate with the sub-tank 121.

Figure 8:
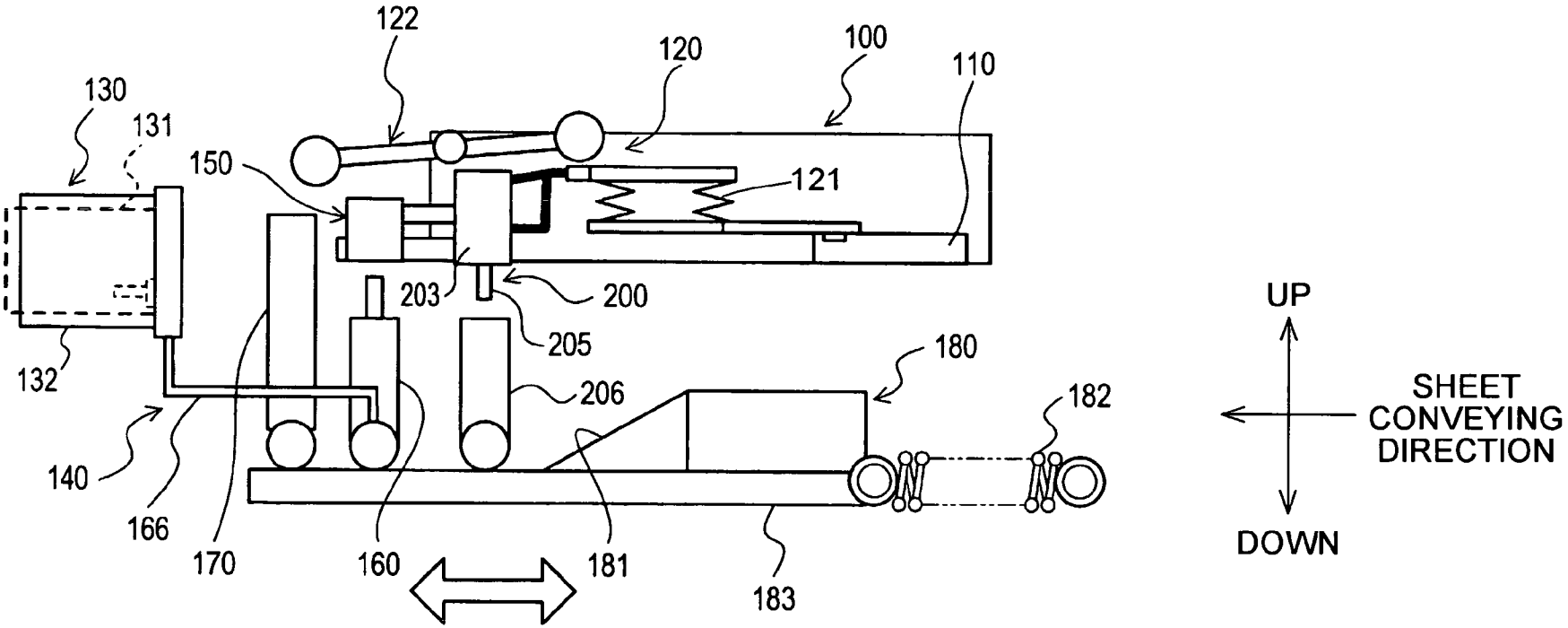
FIG. 8 is a schematic diagram of an ink supply mechanism according to a fifth embodiment of the invention.
Figure 9B:
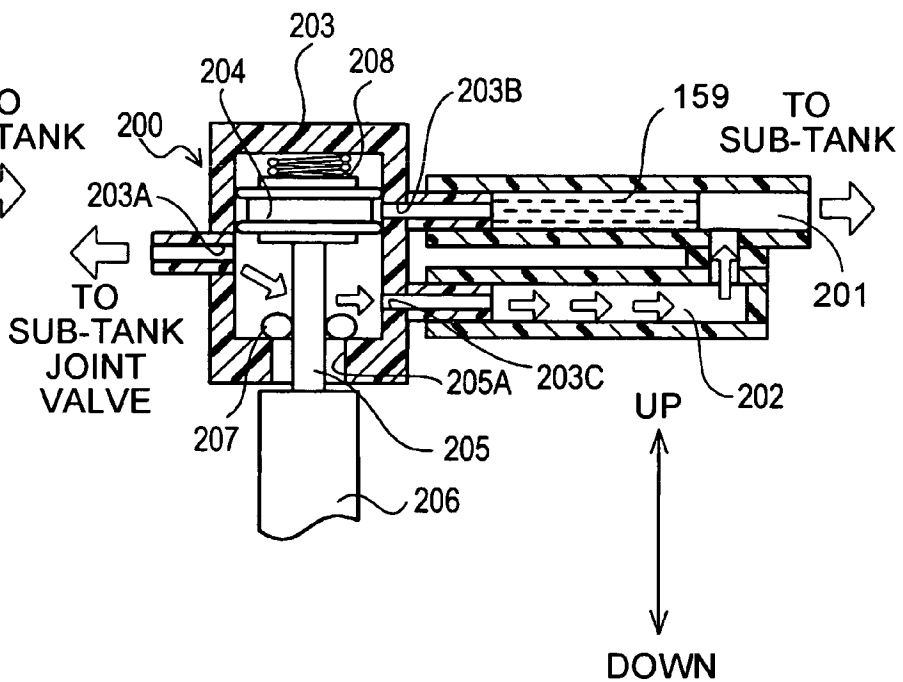
FIGS. 9A and 9B are illustrative diagrams showing an ink supply operation according to the fifth embodiment of the invention
Figure 9A:
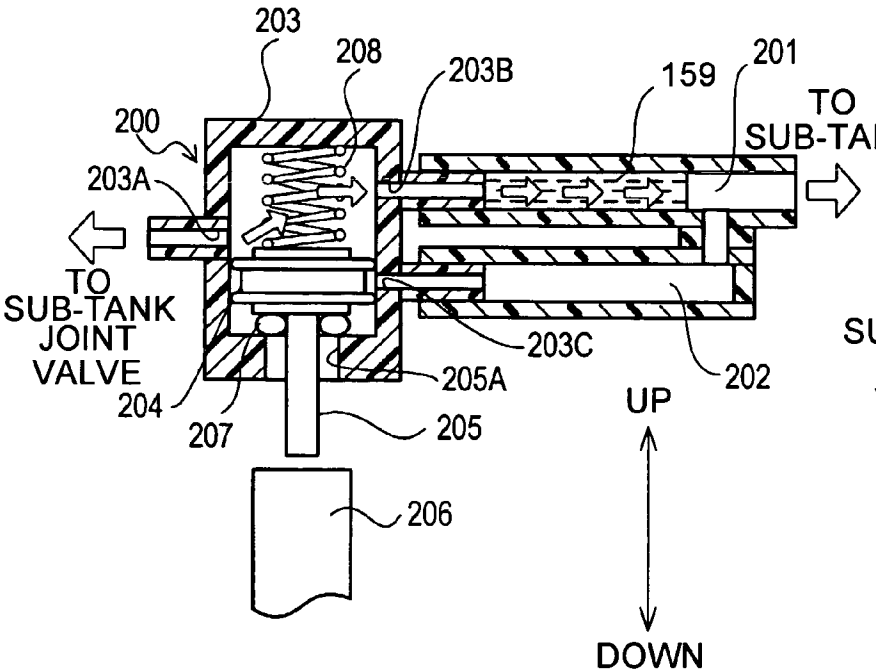

FIG. 8 is a schematic diagram showing the locations of an ink supply mechanism 140 which includes a switching mechanism 200. FIGS. 9A and 9B show the structure of the switching mechanism 200, which includes a housing 203 in which a piston valve 204 is shiftably disposed, a shaft 205 that moves the piston valve 204, and a push rod 206 that pushes the shaft 205 when the push rod 206 is pushed by a slide cam 180 (see FIG. 8). As shown in FIGS. 8, 9A, and 9B, the ink path extending from the sub-tank joint valve 150 to the sub-tank 121 branches into a first ink path 201 and a second ink path 202, which join into one before the sub-tank 121.

The ink absorber 159 is disposed in the first ink path 201, while no ink absorber is disposed in the second ink path 202. The switching mechanism 200 is disposed between the sub-tank joint valve 150 and the first and second ink paths 201, 202. The switching mechanism 200 switches between a state where the sub-tank joint valve 150 communicates with the first ink path 201 and a state where the sub-tank joint valve 150 communicates with the second ink path 202.

The housing 203 of the switching mechanism 200 has a first port 203A communicating with the sub-tank joint valve 150, a second port 203B communicating with the first ink path 201, and a third port 203C communicating with the second ink path 202.

The piston valve 204 is disposed in the housing 203 connected to the shaft 205. The piston valve 204 is shiftable between a state where the housing 203 communicates with the second port 203B and a state where the housing 203 communicates with the third port 203C.

As shown in FIG. 8, the shaft 205 penetrates the housing 203 and extends toward a slide cam 180. The push rod 206 is disposed to face an end of the shaft 205 so as to push the shaft 205 when the push rod 206 is pushed by the slide cam 180 toward the housing 203.

As shown in FIGS. 9A and 9B, an O ring 207 is provided as a sealing member to prevent ink leakage from an opening 205A through which the shaft 205 penetrates. A coil spring 208 is provided as an elastic member to push the shaft 205 and the piston valve 204 toward the push rod 206.

As shown in FIG. 9A, when no ink is supplied to the sub-tank 121, including during the image forming process, the piston valve 204 is pushed by the coil spring 208 toward the push rod 206 so as to be shifted to a position to block the third port 203C. Thus, the first ink path 201 is opened and the second ink path 202 is blocked.

As shown in FIG. 9B, to supply ink to the sub-tank 121, the push rod 206 is pushed upward toward the housing 203 by the push rod 206, which is in turn shifted by the slide cam 180. Accordingly, the piston valve 204 is shifted to a position to block the second port 203B. Thus, the first ink path 201 is blocked and the second ink path 202 is opened.

Therefore, when no ink is supplied to the sub-tank 121, including during the ink forming process, the first ink path 201 is opened and ink in the sub-tank 121 is absorbed by the ink absorber 159 and the pressure in the sub-tank 121 is kept at less than the atmospheric pressure. This maintains meniscuses formed in the nozzles of the printhead 110.

However, when ink is supplied to the sub-tank 121, the second ink path 202 is opened and ink is supplied to the sub-tank 121 via the second ink path 202 with no ink absorber. This enables quick ink supply to the sub-tank 121.

Although, in the above-described first embodiment, the sub-tank 121 has a form of bellows, the invention is not limited to this embodiment. For example, the sub-tank 121 may alternatively be a tank configured to be unchanged in volume, or a tank configured to be changed in volume and having a cylinder and a piston.

Although, in the above-described first embodiment, the amount of ink remaining in the sub-tank 121 is estimated based on the number of ink ejections, the invention is not limited to this embodiment. For example, the amount of ink remaining in the tank 121 may be estimated based on changes in the electrical resistance in the sub-tank 121.

Although, in the above-described first embodiment, the sub-tank joint valve 150 communicates with the sub-tank 121 at the upper side of the sub-tank 121 while the sub-tank 121 communicates with the print head 110 at the lower side of the sub-tank 121, the invention is not limited to this embodiment. For example, the sub-tank joint valve 150 may communicate with the sub-tank 1 at the lower side of the sub-tank 121 while the sub-tank 121 may communicate with the print head 110 at the upper side of the sub-tank 121.

Although, in the above-described first embodiment, the main tank joint valve 160 and the push rod 170 are shifted by the slide cam 180, the invention is not limited to this embodiment. For example, the main tank joint valve 160 and the push rod 170 may be shifted by an electrical actuator such as an electromagnetic solenoid.

The inkjet printer according to the above-described first embodiment may be used, for example, by being connected to a personal computer. In another example, the inkjet printer according to the above-described first embodiment may be adopted as a printing section in a facsimile machine.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. An inkjet printer comprising:

a main tank that holds ink;

a sub-tank unit including a sub-tank;

an ink supply mechanism including an ink absorber; and a printhead unit including a printhead for ejecting ink onto a sheet; and wherein the ink supply mechanism connects the main tank to the sub-tank, so as to supply ink from the main tank to the sub-tank;

wherein the sub-tank unit is mounted on the printhead unit and supplies ink to the printhead;

wherein the main tank and the sub-tank are configured so as to be disconnected from each other via the ink supply mechanism when ink is not being supplied from the main tank to the sub-tank;

wherein the main tank and the sub-tank are configured so as to be connected to each other via the ink supply mechanism when ink is being supplied from the main tank to the sub-tank;

wherein, when ink is not being supplied from the main tank to the sub-tank the ink absorber is positioned in the ink supply mechanism such that the ink absorber absorbs ink from the sub-tank;

wherein, when ink is being supplied from the main tank to the sub-tank, the ink absorber is positioned in the ink supply mechanism such that the ink absorber presents less resistance to ink flowing through the ink supply mechanism into the sub-tank than when ink is not being supplied from the main tank to the sub-tank;

wherein the ink supply mechanism further comprises:

a connection port that connects to the main tank when ink is to be supplied from the main tank to the sub-tank;

an ink path extending from the connection port to the sub-tank; and a retracting mechanism;

wherein, when ink is not being supplied from the main tank to the sub-tank, the ink absorber is disposed in the ink path such that the ink absorber absorbs ink from the sub-tank;

wherein, when ink is supplied from the main tank to the sub-tank, the retracting mechanism is configured to retract at least a part of the ink absorber away from the ink path.

2. The inkjet printer according to claim 1;

wherein the ink supply mechanism further includes a valve member disposed at the connection port and configured to open and close the connection port so as to enable and disable, respectively, ink flow from the main tank into the ink path; and wherein the retracting mechanism retracts the at least a part of the ink absorber away from the ink path by shifting the ink absorber along with the valve member.

3. The inkjet printer according to claim 2;

wherein the ink absorber is integral with the valve member.

4. The inkjet printer according to claim 1;

wherein the ink absorber is made of an elastically deformable material; and wherein the retracting mechanism retracts the at least a part of the ink absorber away from the ink path by compressing the ink absorber.

5. The inkjet printer according to claim 1;

wherein the printhead unit is configured to reciprocate in a direction perpendicular to a sheet conveying direction.

6. An inkjet printer comprising:

a main tank that holds ink;

a sub-tank unit including a sub-tank;

an ink supply mechanism including an ink absorber; and a printhead unit including a printhead for ejecting ink onto a sheet; and wherein the ink supply mechanism connects the main tank to the sub-tank, so as to supply ink from the main tank to the sub-tank;

wherein the sub-tank unit is mounted on the printhead unit and supplies ink to the printhead;

wherein the main tank and the sub--tank are configured so as to be disconnected from each other via the ink supply mechanism when ink is not being supplied from the main tank to the sub-tank:

wherein the main tank and the sub-tank are configured so as to be connected to each other via the ink supply mechanism when ink is being supplied from the main tank to the sub-tank;

wherein, when ink is not being supplied from the main tank to the sub-tank, the ink absorber is positioned in the ink supply mechanism such that the ink absorber absorbs ink from the sub-tank;

wherein, when ink is being supplied from the main tank to the sub-tank, the ink absorber is positioned in the ink supply mechanism such that the ink absorber presents less resistance to ink flowing through the ink supply mechanism into the sub-tank than when ink is not being supplied from the main tank to the sub-tank;

wherein the ink supply mechanism further comprises:

a connection port that connects to the main tank when ink is to be supplied from the main tank to the sub-tank;

a first ink path extending from the connection port to the sub-tank;

a second ink path extending from the connection port to the sub-tank; and a switching mechanism that has a first position in which the connection port communicates with the sub-tank via the first ink path, and a second position in which the connection port communicates with the sub-tank via the second ink path;

wherein the ink absorber is disposed in the first ink path such that the ink absorber absorbs ink from the sub-tank;

wherein, when ink is not being supplied from the main tank to the sub-tank, the switching mechanism is in the first position, bringing the connection port in communication with the sub-tank via the first ink path; and wherein, when ink is being supplied from the main tank to the sub-tank, the switching mechanism is in the second position, bringing the connection port in communication with the sub-tank via the second ink path.

7. The inkjet printer according to claim 6;

wherein the ink absorber is disposed inside the switching mechanism.

8. An inkjet printer comprising:

a main tank that holds ink;

a sub-tank unit including a sub-tank;

an ink supply mechanism including an ink absorber; and a printhead unit including a printhead for ejecting ink onto a sheet; and wherein the ink supply mechanism connects the main tank to the sub-tank, so as to supply ink from the main tank to the sub-tank;

wherein the sub-tank unit is mounted on the printhead unit and supplies ink to the printhead;

wherein the main tank and the sub-tank are configured so as to be disconnected from each other via the ink supply mechanism when ink is not being supplied from the main tank to the sub-tank;

wherein the main tank and the sub-tank are configured so as to be connected to each other via the ink supply mechanism when ink is being supplied from the main tank to the sub-tank;

wherein, when ink is not being supplied from the main tank to the sub-tank, the ink absorber is positioned in the ink supply mechanism such that the ink absorber absorbs ink from the sub-tank;

wherein, when ink is being supplied from the main tank to the sub-tank, the ink absorber is positioned in the ink supply mechanism such that the ink absorber presents less resistance to ink flowing through the ink supply mechanism into the sub-tank than when ink is not being supplied from the main tank to the sub-tank;

wherein the ink supply mechanism further includes a main tank joint valve and a sub-tank joint valve;

wherein, when ink is being supplied from the main tank to the sub-tank, the main tank joint valve is connected to the sub-tank joint valve;

wherein, when ink is not being supplied from the main tank to the sub-tank, the main tank joint valve is disconnected from the sub-tank joint valve; and wherein the ink absorber is disposed inside the sub-tank joint valve.

9. An inkjet printer comprising:

a main tank that holds ink:

a sub-tank unit including a sub-tank;

an ink supply mechanism including an ink absorber; and a printhead unit including a printhead for ejecting ink onto a sheet; and wherein the ink supply mechanism connects the main tank to the sub-tank, so as to supply ink from the main tank to the sub-tank;

wherein the sub-tank unit is mounted on the printhead unit and supplies ink to the printhead;

wherein the main tank and the sub-tank are configured so as to be disconnected from each other via the ink supply mechanism when ink is not being supplied from the main tank to the sub-tank;

wherein the main tank and the sub-tank are configured so as to be connected to each other via the ink supply mechanism when ink is being supplied from the main tank to the sub-tank;

wherein, when ink is not being supplied from the main tank to the sub-tank, the ink absorber is positioned in the ink supply mechanism such that the ink absorber absorbs ink from the sub-tank;

wherein, when ink is being supplied from the main tank to the sub-tank, the ink absorber is positioned in the ink supply mechanism such that the ink absorber presents less resistance to ink flowing through the ink supply mechanism into the sub-tank than when ink is not being supplied from the main tank to the sub-tank;

wherein the ink supply mechanism further comprises:

a connection port that connects to the main tank when ink is to be supplied from the main tank to the sub-tank;

an ink path extending from the connection port to the sub-tank;

a main tank joint valve;

a sub-tank joint valve; and a retracting mechanism which includes a retracting mechanism housing;

wherein the retracting mechanism housing is in communication with the sub-tank joint valve and is positioned between the sub-tank joint valve and the sub-tank;

wherein, when ink is being supplied from the main tank to the sub-tank, the main tank joint valve is connected to the sub-tank joint valve;

wherein, when ink is not being supplied from the main tank to the sub-tank, the main tank joint valve is disconnected from the sub-tank joint valve; and wherein the ink absorber is disposed inside the retracting mechanism housing.

10. The inkjet printer according to claim 9;

wherein, when ink is not being supplied from the main tank to the sub-tank, the ink absorber is disposed in the ink path such that the ink absorber absorbs ink from the sub-tank;

wherein, when ink is supplied from the main tank to the sub-tank, the retracting mechanism is configured to retract at least a part of the ink absorber away from the ink path.

* * * * *